US005562123A

United States Patent [19]

Howard

[11] Patent Number: 5,562,123

[45] Date of Patent: Oct. 8, 1996

[54] OVERFILL PREVENTION VALVE

[75] Inventor: Rodney S. Howard, Hemel Hempstead, England

[73] Assignee: Lucas Industries Public Limited Company, England

[21] Appl. No.: 342,373

[22] Filed: Nov. 18, 1994

[30] Foreign Application Priority Data

Dec. 15, 1993 [GB] United Kingdom ..... 9325634

[51] Int. Cl.[6] ..... F01M 1/18

[52] U.S. Cl. ..... 137/588; 137/595; 184/6.4; 184/103.1; 123/196 S

[58] Field of Search ..... 137/588, 595; 184/6.4, 103.1; 123/196 R, 196 S

[56] References Cited

U.S. PATENT DOCUMENTS

| | | | |
|---|---|---|---|
| 2,617,495 | 11/1952 | Johnson | 184/103.1 X |
| 2,841,170 | 7/1958 | Kalsey | 137/595 X |
| 4,535,797 | 8/1985 | Rosaen | 137/87 |
| 4,569,196 | 2/1986 | Waddington et al. | 184/6.4 X |
| 4,589,524 | 5/1986 | Laycock | 184/103.1 |
| 4,883,148 | 11/1989 | Welch | 184/6.4 |
| 4,895,219 | 1/1990 | Welch et al. | 184/6.4 |
| 4,932,446 | 6/1990 | Behling | 137/588 X |

FOREIGN PATENT DOCUMENTS 1065457 4/1952 France .

*Primary Examiner*—John Rivell
*Attorney, Agent, or Firm*—Cesari and McKenna

[57] ABSTRACT

An overfill prevention valve is provided in the fill line of a tank. The valve is arranged such that the valve is held at a closed position unless an overflow for the tank is open.

4 Claims, 2 Drawing Sheets

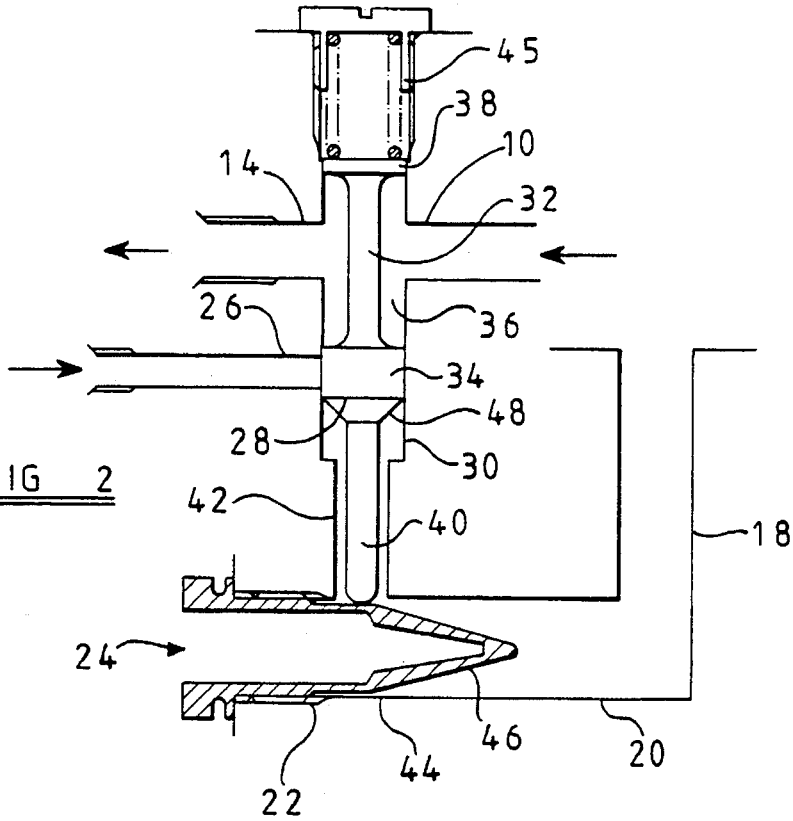
FIG 2
FIG 3
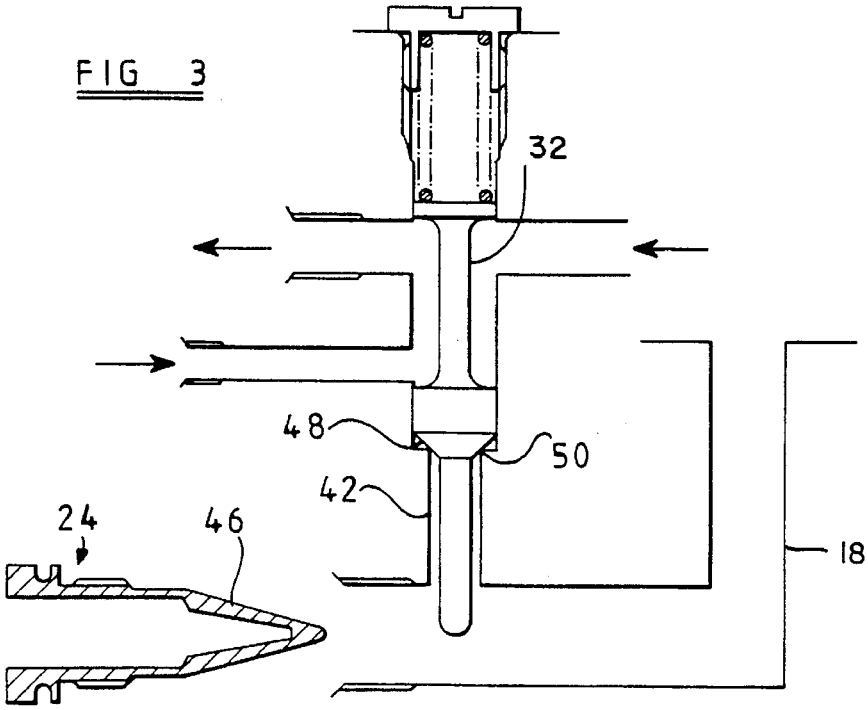

OVERFILL PREVENTION VALVE

The present invention relates to an overfill prevention valve. Such a valve is suitable for use in filling a tank or reservoir to a level determined by an outlet, such as an overflow, which, in normal use, is closed except during filling of the tank.

Known self contained liquid circulation systems, such as oil cooling and/or lubrication systems, generally require a predetermined volume of fluid to be admitted into a tank (herein including a reservoir or a sump). Furthermore, the tank may not be filled directly, but the liquid may pass through a distribution network thereby priming the network before flowing into the tank. In such systems, it is known to fill the tank up to a level determined by a standpipe or some other overflow arrangement which is normally closed.

Overfilling may occur if the overflow is inadvertently left closed during the filling operation. Such overfilling may give rise to increased churning of the liquid which may affect equipment performance and lead to elevated temperatures and internal pressures.

According to a first aspect of the present invention, there is provided an overfill prevention valve having a first inlet, a first outlet, a second inlet, a second outlet, and at least a first valve member arranged to inhibit fluid flow communication between the first inlet and the first outlet when fluid flow communication between the second inlet and the second outlet is inhibited.

Preferably a second valve member is provided for controlling fluid flow from the second inlet to the second outlet. Advantageously the second valve member is a plug. The plug may be arranged to be removably secured to part of a valve housing or some other structure adjacent the second outlet so as to close the second outlet.

The plug may be profiled so as to have an extending portion which, when the plug is positioned to close the second outlet, abuts a portion of the first valve member and holds the first valve member at a first position for preventing fluid flow communication between the first inlet and the first outlet.

Preferably the first valve member is biased towards a second position for permitting fluid flow communication between the first inlet and the first outlet. The biasing may be provided by a spring, such as a compression spring. The biasing moves the first valve member to the second position when the plug is removed from the second outlet.

According to a second aspect of present invention, there is provided a fluid reservoir comprising: a vessel having at least a first fluid path for admitting fluid into the vessel and an overflow; means for closing the overflow; means for closing the first fluid path; and interlocking means for preventing the first fluid path from being opened unless the overflow is open.

Preferably the vessel is a tank having an inlet, an outlet and an overflow.

Preferably the tank is connected to a valve according to the first aspect of the present invention, the tank inlet being connected to receive fluid from the first outlet of the valve and the overflow being connected to the second inlet of the valve.

Alternatively the tank may have an overflow plug which is movable from a closed position in order to open the overflow and an inlet valve may be provided, the valve comprising a valve casing having a valve inlet and a valve outlet, and a valve member movable between a first position for permitting fluid flow communication between the valve inlet and the valve outlet and a further position for preventing fluid flow, the valve being positioned such that a portion of the valve member abuts the overflow plug when the overflow plug is at the closed position, thereby holding the valve member away from the first position.

Advantageously the valve member is biased towards the first position. The biasing may be provided by a spring.

It thus possible to provide an arrangement in which a tank is prevented from being filled unless the overflow therefrom has been opened.

The present invention will further be described, by way of example, with reference to the accompanying drawings, in which:

FIG. 2 is a diagram of the valve shown in FIG. 1 at a closed position; and FIG. 3 is a diagram of the valve shown in FIG. 2 at an open position.

Figure 1:
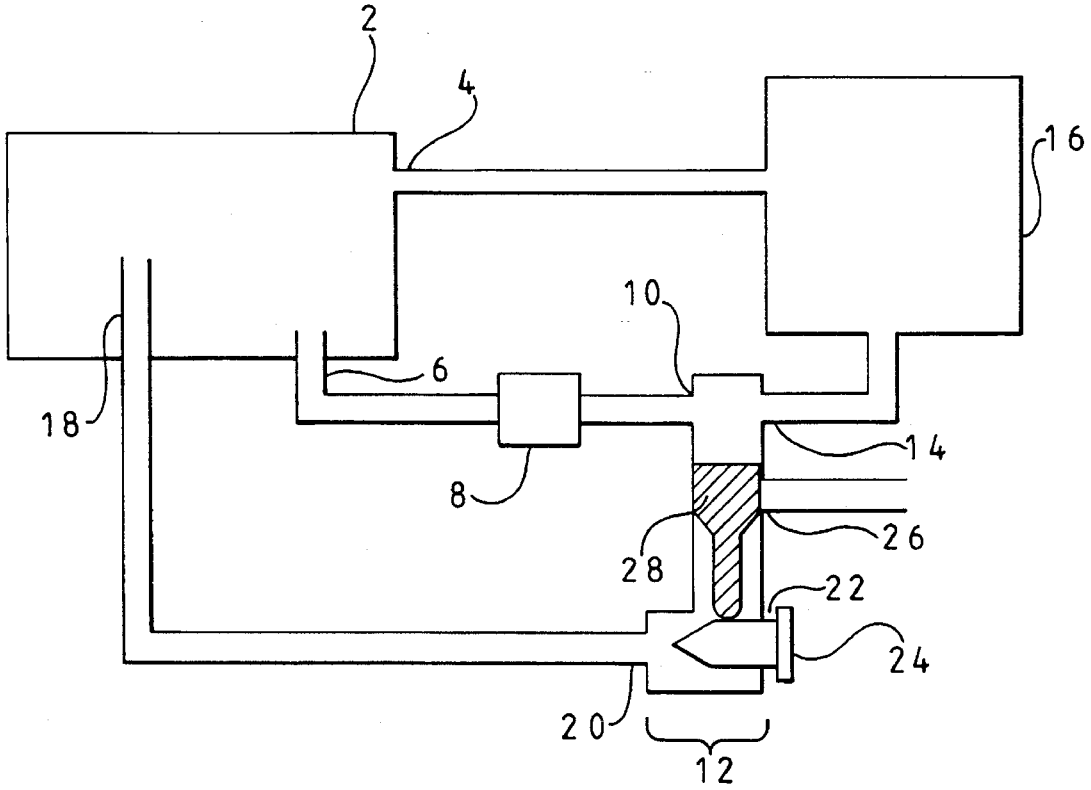
FIG. 1 is a schematic diagram of an oil cooling/lubrication system incorporating an overflow prevention valve and tank arrangement constituting an embodiment of the present invention.

The cooling and lubrication system shown in FIG. 1 comprises a tank 2 having an inlet 4 and an outlet 6, a pump 8 and an overflow prevention valve 12 having three inlets and two outlets. The outlet 6 of the tank 2 is connected to an inlet of a pump 8. An outlet of the pump 8 is connected to a third inlet 10 of an overflow prevention valve 12. A first outlet 14 of the valve 12 is connected to a distribution network 16. The distribution network 16 may include heat exchangers, filters and spray jets for spraying the oil onto bearings, and the like. An outlet from the distribution network 16 is connected to the inlet 4 of the tank 2.

A stand pipe 18 extends from the base of the tank 2 thereby defining a maximum fill level. The stand pipe 18 is connected to a second inlet 20 of the overflow prevention valve 12. The second inlet 20 is in fluid flow communication with a second outlet 22 of the valve 12. A removable overflow plug 24 is provided for selectively opening or closing the second outlet 22.

A first inlet 26 of the overflow prevention valve 12 is arranged to cooperate with a valve member 28 such that movement of the valve member 28 when the overflow plug 24 is removed from the second outlet 22 causes the first inlet 26 to be in fluid flow communication with the first outlet 14.

The valve member 28 comprises an elongate member 32 movable within a cylinder 30, as shown in FIG. 2. The member 32 carries an enlarged region 34 which is in substantially fluid sealed engagement with the cylinder 30. An annular chamber 36, bounded by the enlarged region 34, the cylinder 30 and a first end 38 of the valve member 28, is in constant fluid flow communication with the first outlet 14 and the third inlet 10. The first outlet 14 and the third inlet 10 are in fluid flow communication with the cylinder 30 at a first end thereof.

A portion 40 of the valve member 28 extends through a passage 42, formed at a second end of the cylinder 30, and into a passage 44 defining the second outlet 22.

A spring 45 is arranged to urge the valve member 28 towards the second end of the cylinder 30.

The overflow plug 24 has a generally conical end section 46. When the overflow plug 24 is inserted into the second outlet 22 so as to close the second outlet, the overflow plug 24 bears against the portion 40 of the valve member 28 and urges the valve member to move to the position shown in FIG. 2. Thus, the enlarged region 34 is positioned so as to prevent fluid flow communication between the first inlet 26 and the first outlet 14.

Removal of the overflow plug 24 permits the valve member 28 to move under the urging of the spring 45 to the position shown in FIG. 3, thereby permitting fluid flow communication between the first inlet 26 and the first outlet 14 via the chamber 36. Fluid flow communication between the first inlet 26 and the second outlet 22 is prevented by virtue of fluid sealed engagement between a conical seat 48 formed on the enlarged region 34 with a first end 50 of the passage 42.

In order to fill the cooling and lubrication system shown in FIG. 1, oil is supplied to the first inlet 26 of the overflow prevention valve 12. However, filling cannot commence until the overflow plug 24 has been removed from the second outlet 22. The pump 8 is either operated or designed so as to substantially prevent filling of the tank 2 occurring via the tank outlet 6. Thus, the oil supplied to the first inlet 26 of the valve 12 flows to the tank 2 via the annular chamber 36, the first outlet 14, the distribution network 16 and the tank inlet 4. Filling the tank 2 via the distribution network 16 ensures that the network 16 is primed.

The tank 2 is prevented from being overfilled since excess oil will flow out of the tank 2 via the stand pipe 18 and the second inlet and outlet 20 and 22, respectively, of the overflow prevention valve 12.

Thus inadvertent overfilling of the tank 2 due to failure to open the overflow outlet therefrom is avoided.

In an alternative arrangement, a fill valve having a single inlet and outlet (corresponding to the first inlet 26 and outlet 14) and having a portion of a valve member extending therefrom, may be positioned adjacent an outlet of the stand pipe 18. The valve may be arranged such that the valve is closed when an overflow plug is inserted into the outlet of the stand pipe. It is thus possible to provide a simple and inexpensive apparatus for preventing the overfilling of a tank or similar reservoir.

I claim:

1. An overfill prevention valve for use in connection with a fluid reservoir having a fluid inlet and a fluid outflow, the valve including a first inlet for connection to a fluid supply, a first outlet for connection to said reservoir inlet, and a valve member movable between an open position in which the first inlet communicates with the first outlet and a closed position in which said communication is prevented, the valve further including an overflow passage for connection to a reservoir overflow conduit and an overflow plug removably closing said overflow passage, said plug and said valve member cooperating such that said valve member cannot occupy said open position while said plug is in position closing said overflow passage.

2. An overfill prevention valve as claimed in claim 1, in which said plug has an extending portion and said valve member has an extending portion, and in which, when said plug is positioned to close said overflow passage, said extending portion of said plug abuts said extending portion of said valve member and holds said valve member at a first position for substantially preventing fluid flow communication between said first inlet and said first outlet.

3. An overfill prevention valve as claimed in claim 1, in which said valve member is biased towards an open position for permitting fluid flow communication between said first inlet and said first outlet.

4. An overfill prevention valve as claimed in claim 3, further comprising a spring arranged to urge said valve member towards the open position.

* * * * *